US009329559B2

(12) United States Patent
Okano et al.

(10) Patent No.: US 9,329,559 B2
(45) Date of Patent: May 3, 2016

(54) IMAGE FORMATION DEVICE AND BELT UNIT THEREFOR

(75) Inventors: Tetsuya Okano, Aichi (JP); Kentaro Murayama, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 432 days.

(21) Appl. No.: 13/432,768

(22) Filed: Mar. 28, 2012

(65) Prior Publication Data

US 2012/0301199 A1 Nov. 29, 2012

(30) Foreign Application Priority Data

May 27, 2011 (JP) ..... 2011-119363

(51) Int. Cl.
*G03G 15/00* (2006.01)
*G03G 21/00* (2006.01)

(52) U.S. Cl.
CPC .... *G03G 15/755* (2013.01); *G03G 2215/00151* (2013.01); *G03G 2215/0141* (2013.01)

(58) Field of Classification Search
CPC ..... G03G 15/755; G03G 2215/00143; G03G 2215/00151; G03G 2215/00156; G03G 21/0041; G03G 5/005; G03G 15/166; G03G 15/168; G03G 15/2075; G03G 21/169; B65H 2404/254; B65H 2404/222; B65H 5/021; B65H 2404/251; B65H 2404/2222; B65H 2404/224; B65H 2404/211; B65H 2404/22
USPC ..... 399/388, 165; 271/275, 198; 198/840, 198/837, 839, 836.3, 806
See application file for complete search history.

(56) References Cited

U.S. PATENT DOCUMENTS

| | | | | |
|---|---|---|---|---|
| 5,481,338 | A | 1/1996 | Todome | |
| 5,619,310 | A * | 4/1997 | Todome | G03G 15/6558 198/806 |
| 6,141,522 | A * | 10/2000 | Tsuruoka et al. | 399/302 |
| 7,350,990 | B2 | 4/2008 | Shin et al. | |
| 2002/0046932 | A1 * | 4/2002 | Wakana | 198/840 |

(Continued)

FOREIGN PATENT DOCUMENTS

| | | |
|---|---|---|
| JP | 06-255826 A | 9/1994 |
| JP | 06-295144 | 10/1994 |

(Continued)

OTHER PUBLICATIONS

Notification of Reasons for Rejection issued in Japanese Application No. 2011-119363 mailed Mar. 26, 2013.

*Primary Examiner* — Matthew G Marini
*Assistant Examiner* — Ruben Parco, Jr.
(74) *Attorney, Agent, or Firm* — Banner & Witcoff, Ltd.

(57) ABSTRACT

An image formation device is provided with an endless belt wound around a driving roller and a driven roller, a driving helical gear integrally provided at an axial end of the driving roller and rotating integrally with the driving roller. The driving helical gear applies a rotational force and an axial force to the driving roller. A plurality of guiding ribs are provided to an inner surface of the endless belt, while a regulating portion is provided at least one of the driving roller and the driven roller. The regulating portion has a regulation surface. When the endless belt moves obliquely in a direction in which the driving helical gear applies the axial force to the driving roller, side surfaces of the guiding ribs contact the regulating surface and prevent the oblique movement of the endless belt.

17 Claims, 7 Drawing Sheets

(56) References Cited

U.S. PATENT DOCUMENTS

| | | | | |
|---|---|---|---|---|
| 2003/0185588 | A1* | 10/2003 | Takami et al. | 399/111 |
| 2005/0248083 | A1* | 11/2005 | Tsutsui | 271/275 |
| 2006/0147198 | A1 | 7/2006 | Shin et al. | |
| 2007/0029717 | A1* | 2/2007 | Mori | 271/8.1 |
| 2007/0147891 | A1* | 6/2007 | Mori | 399/121 |
| 2007/0147903 | A1* | 6/2007 | Mori | 399/264 |
| 2007/0209539 | A1* | 9/2007 | Mori | B41J 2/471 101/425 |
| 2007/0248389 | A1* | 10/2007 | Asakura et al. | 399/328 |
| 2009/0071801 | A1* | 3/2009 | Wolf | 198/617 |
| 2011/0103812 | A1* | 5/2011 | Takasaka et al. | 399/44 |

FOREIGN PATENT DOCUMENTS

| | | | | | |
|---|---|---|---|---|---|
| JP | 08-073066 | | 3/1996 | | |
| JP | 11-160950 | | 6/1999 | | |
| JP | 11-174863 | A | 7/1999 | | |
| JP | 2000-321879 | A | 11/2000 | | |
| JP | 2002-014570 | A | 1/2002 | | |
| JP | 2002-082587 | | 3/2002 | | |
| JP | 2003-098926 | | 4/2003 | | |
| JP | 2003-098927 | | 4/2003 | | |
| JP | 2003-201038 | A | 7/2003 | | |
| JP | 2003-255718 | A | 9/2003 | | |
| JP | 2004069856 | A | 3/2004 | * | G03G 15/20 |
| JP | 2004-151487 | | 5/2004 | | |
| JP | 3588366 | | 11/2004 | | |
| JP | 2004-361576 | A | 12/2004 | | |
| JP | 2005-234466 | A | 9/2005 | | |
| JP | 2006-189792 | | 7/2007 | | |
| JP | 2008-076999 | A | 4/2008 | | |
| JP | 2008304865 | A | 12/2008 | * | G03G 15/16 |
| JP | 2011-053242 | A | 3/2011 | | |

* cited by examiner

IMAGE FORMATION DEVICE AND BELT UNIT THEREFOR

CROSS-REFERENCE TO RELATED APPLICATION

This application claims priority under 35 U.S.C. §119 from Japanese Patent Application No. 2011-119363 filed on May 27, 2011. The entire subject matter of the application is incorporated herein by reference.

BACKGROUND

1. Technical Field

Aspects of the present invention relate to an image formation device and a belt unit for the image formation device.

2. Conventional Art

Conventionally, an image formation device employing a belt unit for feeding a printing sheet has been known. Typically, the belt unit is provided with a driving roller and a driven roller, around which an endless belt is wound. In such a belt unit, if the endless belt moves obliquely, quality of an image formed on the printing sheet, which is fed by the endless belt, is deteriorated.

Here, an oblique movement of the endless belt means the movement of the endless belt, which moves in accordance with the rotation of the driving roller, in the direction of an axis of the driving roller (i.e., in the width direction of the printing sheet).

SUMMARY OF THE INVENTION

In an conventional configuration, guiding rib is provided on an inner surface of the endless belt at end portion, in the width direction, thereof. The guiding rib is a projection protruding inwardly. In view of the above, aspects of the invention provides an improved image formation device in which an oblique movement of an endless belt is suppressed.

According to aspects of the invention, there is provided an image formation device configured to form an image on a sheet. The image formation device is provided with a driving roller, a driven roller, an endless belt wound around the driving roller and the driven roller;

a driving helical gear integrally provided at an axial end of the driving roller, the driving helical gear rotating integrally with the driving roller, the driving helical gear applying a rotational force to the driving roller with applying an axial force to the driving roller, a guiding rib provided to an inner surface of the endless belt, the guiding rib protruding inwardly and being arranged in a direction in which the endless belt rotates, a regulating portion provided at least one of the driving roller and the driven roller, the regulating portion having a regulation surface extending in a direction which intersects with the axial direction of the at least one of the driving roller and the driven roller. When the endless belt moves obliquely in a direction in which the driving helical gear applies the axial force to the driving roller, side surfaces of the guiding rib contacts the regulating surface and prevent the oblique movement of the endless belt.

According to aspects of the invention, there is provided a belt unit for an image formation device configured to form an image on a sheet. The belt unit is provided with a driving roller, a driven roller, an endless belt wound around the driving roller and the driven roller, a driving helical gear integrally provided at an axial end of the driving roller, the driving helical gear rotating integrally with the driving roller, the driving helical gear applying a rotational force to the driving roller with applying an axial force to the driving roller, a guiding rib provided to an inner surface of the endless belt, the guiding rib protruding inwardly and being arranged in a direction in which the endless belt rotates, and a regulating portion provided at least one of the driving roller and the driven roller, the regulating portion having a regulation surface extending in a direction which intersects with the axial direction of the at least one of the driving roller and the driven roller. When the endless belt moves obliquely in a direction in which the driving helical gear applies the axial force to the driving roller, side surfaces of the guiding rib contacts the regulating surface and prevent the oblique movement of the endless belt.

BRIEF DESCRIPTION OF THE ACCOMPANYING DRAWINGS

DESCRIPTION OF EMBODIMENTS

Figure 1:
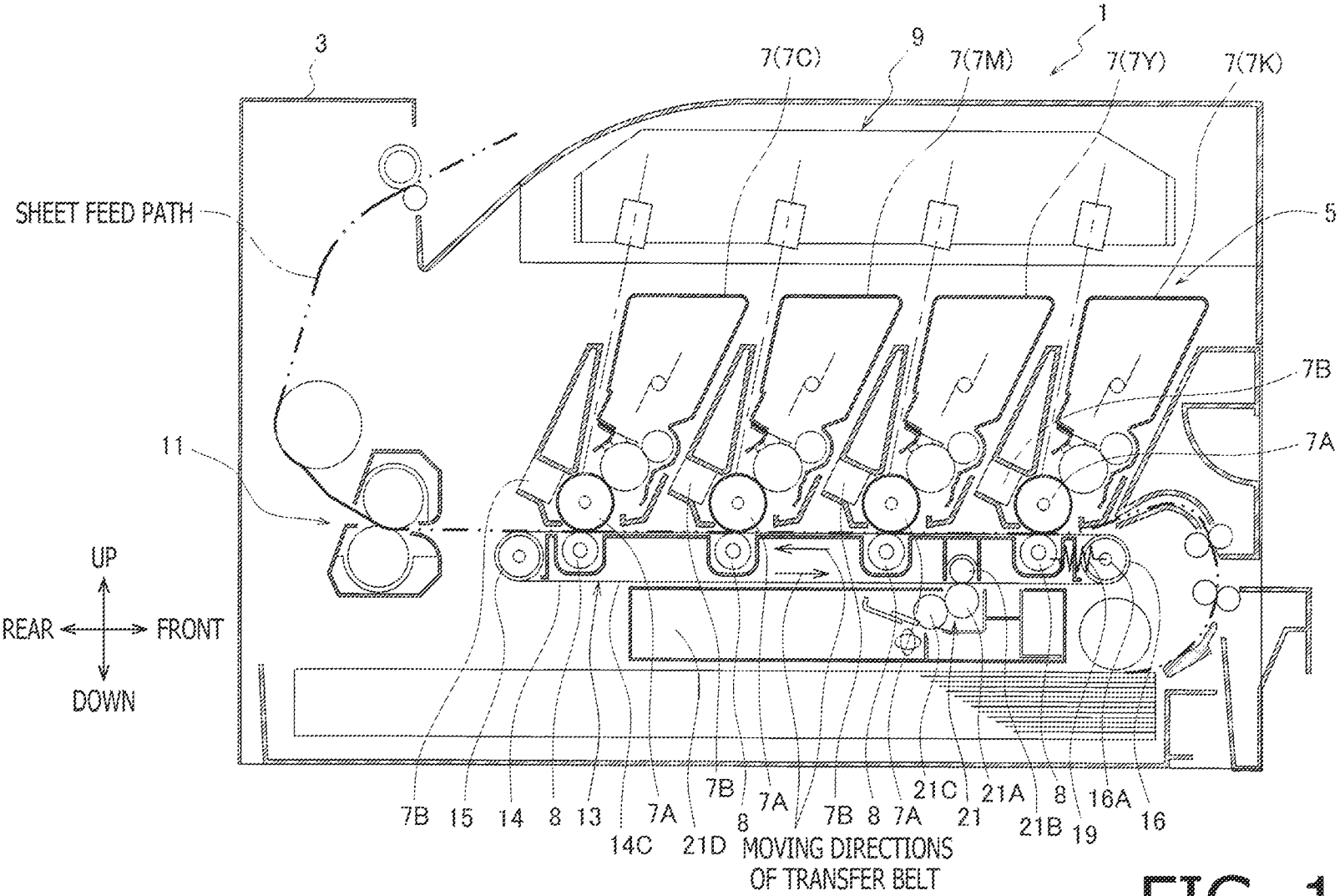
FIG. 1 is a cross sectional side view of an image formation device according to an embodiment of the invention.

Hereinafter, image formation devices according to embodiments of the invention will be described, referring to the accompanying drawings. According to the embodiments, the image formation devices are ones according to an electrophotographic image formation method.

First Embodiment

In an image formation device 1 has a housing 3 which accommodates an image formation unit 5 which is configured to form an image on a printing sheet or an OHP (overhead projector) sheet (hereinafter, simply referred to as a sheet) by applying developer (e.g., toner) in accordance with the electrophotographic image formation method.

Specifically, the image formation unit 5 is a so-called direct tandem type image formation unit. The image formation unit 5 includes a plurality of (four, in this embodiment) process units 7, transfer rollers 8, an exposure unit 9 and a fixing unit 11.

According to the embodiment, there are provided a process unit 7K for black image, a process unit 7Y for yellow image, a process unit 7M for magenta image, and a process unit 7C for cyan image, which are arranged serially in the sheet feed direction, in this order from the upstream side to the downstream side in the sheet feed direction.

Each of the process units 7K-7C includes a photoconductive drum 7A and a charger 7B for uniformly charging the circumferential surface of the photoconductive drum 7A. The charged photoconductive drum 7A is exposed to a light beam emitted by the exposure unit 9 so that electrostatic latent image is formed on the circumferential surface of the photoconductive drum 7A. Then, when the developer is supplied to the photoconductive drum 7A, the developer attracted on the circumferential surface of the photoconductive 7A at a portion corresponding to the electrostatic latent image, that is, an image is developed.

At positions opposite to the photoconductive drums 7A with the transfer belt 14 for feeding the sheet therebetween, transfer rollers 8 for applying developer on the sheet are provided. The developer carried by each photoconductive drum 7A is transferred onto the sheet fed by the transfer belt 14 so that the four color images are directly overlaid on the sheet. Then, the transferred images are heated by the fixing unit 11 and fixed on the sheet.

Figure 2:
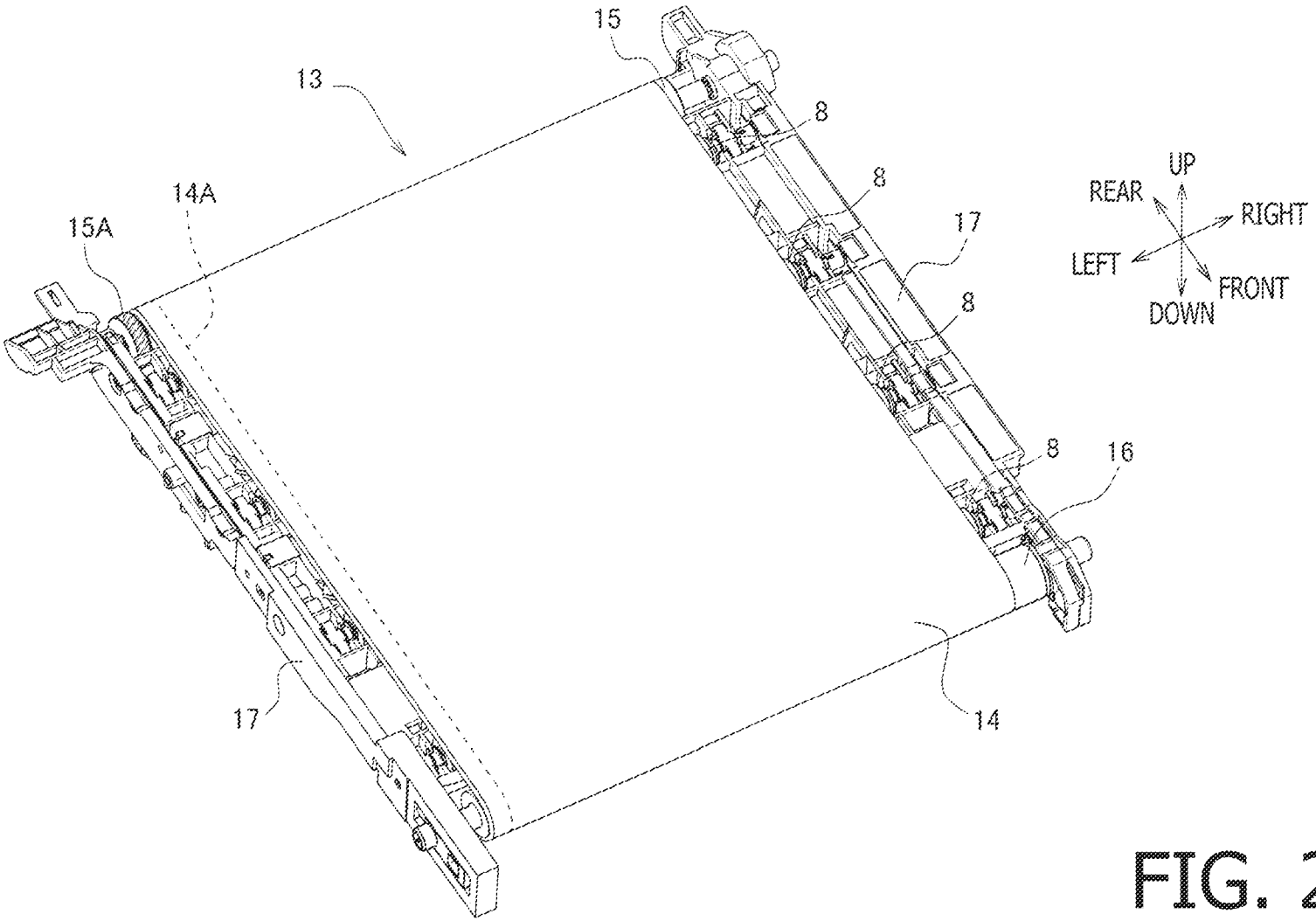
FIG. 2 is a perspective view of a belt unit employed in the image formation device shown in FIG. 1.
Figure 3A:
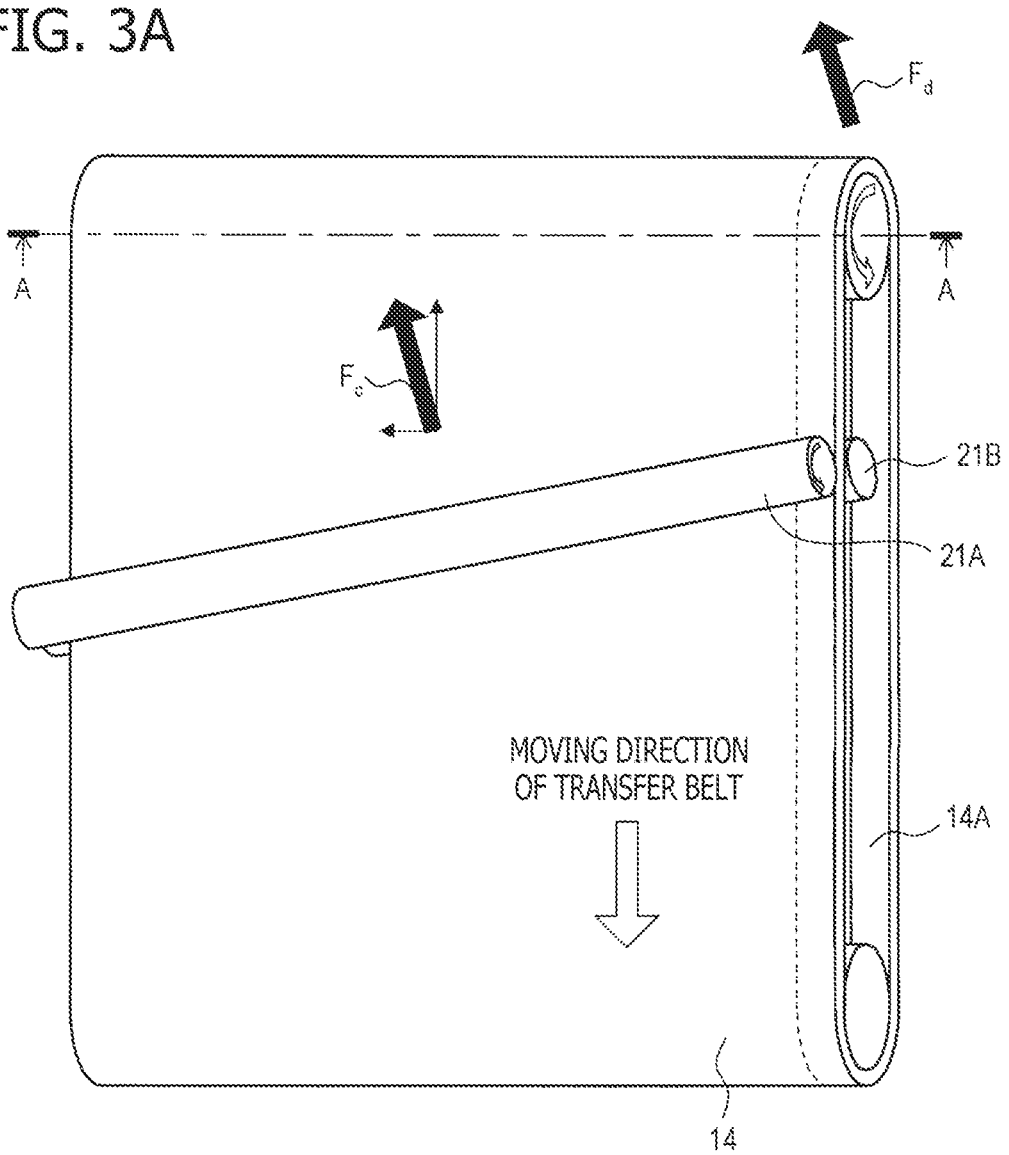
FIG. 3A shows the belt unit according to a first embodiment of the invention, viewed from a belt cleaner side.
Figure 3B:
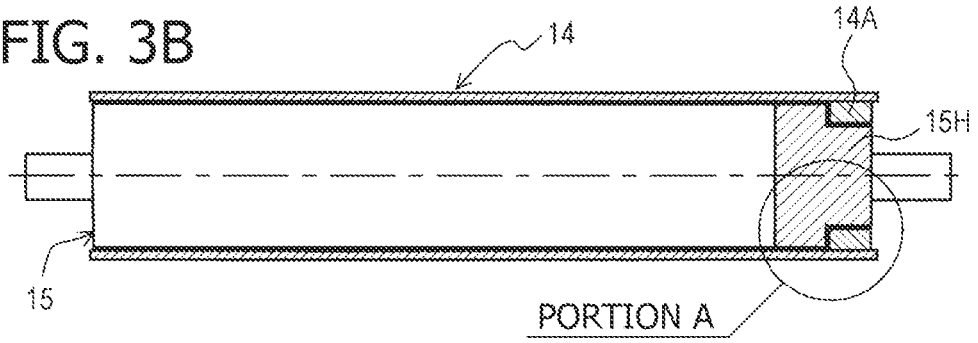
FIG. 3B is a cross sectional view of the belt unit taken along a line A-A.

The belt unit 13 is provided with, as shown in FIG. 2, a transfer belt 14, a driving roller 15, a driven roller 16, and frames 17 which rotatably support the driving roller 15 and the driven roller 16 at their axial end portions. The belt unit 13 is configured to be removably attached to the main body of the image formation device 1.

The transfer belt 14 is an endless belt made of resin (which has thermoplastic elastomer resin) and wound around the driving roller 15 and the driven roller 16 (see FIG. 1).

On one side end portion, in the width direction, of the inner surface of the transfer belt 14, a guiding rib 14A is provided such that the guiding rib 14A extends along a rotational direction of the endless belt 14 and protruded inwardly. It is noted that the width direction is a direction parallel with the axis of the driving roller 15 (or the driven roller 16). The guiding rib 14A is provided integrally with the transfer belt 14 with adhesive agent.

The driving roller 15 is rotatably supported by the frames 17 such that its axial position is fixed with respect to the frames 17. On one axial side of the driving roller 15 (on a side where the guiding rib 14A is provided), a helical gear 15A, which rotates integrally with the driving roller 15, is provided.

Figure 4A:
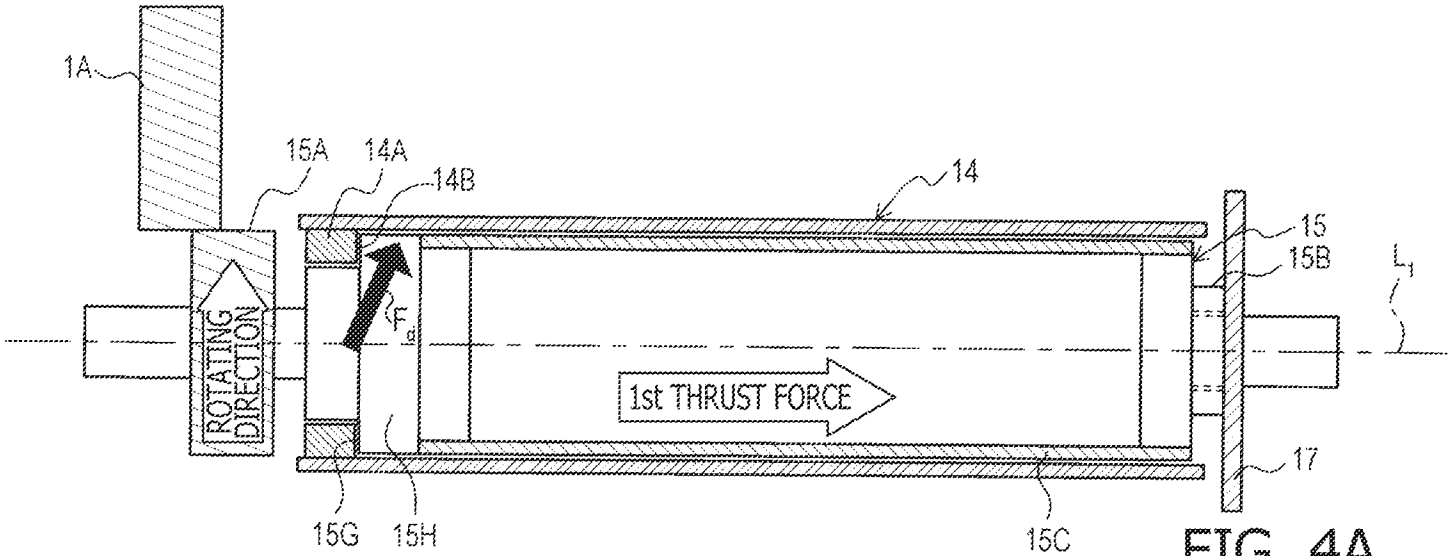
FIG. 4A shows a driving roller viewed from the belt cleaner side.

The helical gear 15A receives a driving force from a device side helical gear 1A (see FIG. 4A) and transmits the driving force to the driving roller 15. The device side helical gear 1A is rotated directly or indirectly by a motor (not shown) provided to the main body of the image formation device. As the driving roller 15 rotates and the transfer belt rotates (i.e., moves), the driven roller 16 is rotated by the movement of the transfer belt 14.

The helical gear 15A is configured such that a direction where the teeth thereof extend is inclined with respect to a rotational axis L1 of the helical gear 15A and the driving roller 15. Therefore, between the device side helical gear 1A and the helical gear 15A, a force Fd containing a component parallel with the axes thereof is generated.

According to the embodiment, the direction where the teeth of the helical gear 15A is determined such that a direction in which a force the helical gear 15A applies to the driving roller 15 in its axial direction (hereinafter, referred to as a first thrust force) is coincide with a direction from one end (the helical gear 15A side) to the other end of the driving roller 15.

On the other side of the driving roller 15, a thrust bearing 15B is provided. The thrust bearing 15B is arranged between the frame 17 and the driving roller 15 so that it receives the first thrust force applied to the driving roller 15, with regulating an axial position of the driving roller 15

The thrust bearing 15B is configured to slidably contact the side end of the driving roller 15 so that it does not prevent the rotation of the driving roller 15, while regulating the axial position thereof. Specifically, according to the embodiment, the thrust bearing 15B has a shape of a flat washer, and made of material which has relatively small frictional coefficient (e.g., POM).

Figure 4B:
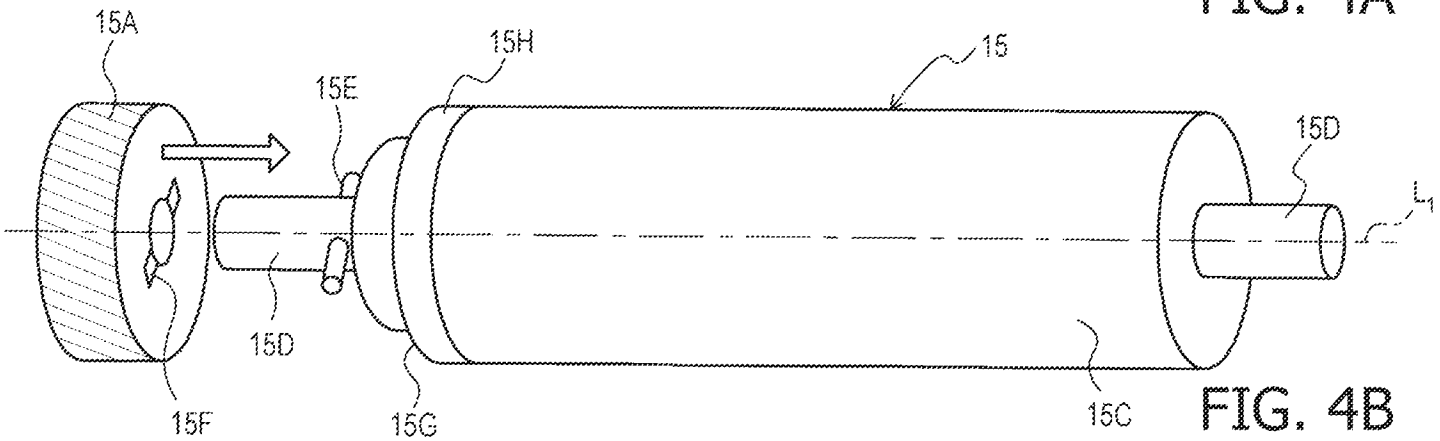
FIG. 4B is a perspective view of the driving roller shown in FIG. 4A.

The driving roller 15 includes, as shown in FIG. 4B, a cylindrical roller portion 15C which contacts the inner surface of the transfer belt 14, and a roller shaft 15D which closes both ends of the cylindrical roller portion 15C and rotatably supports the same.

The roller shaft 15D is provided with engaging protrusions 15E, which are configured to fitted in engaging openings 15F formed on the helical gear 15A so that the rotational force and the first thrust force from the helical gear 15E is transmitted to the driving roller 15.

At least one of the driving roller 15 and the driven roller 16 (according to the embodiment, the driving roller 15) is provided with a regulation portion 15H is formed. The regulation portion 15H is a stepped portion formed with a regulating surface 15G which faces the side surface 14B of the guiding rib 14A and extends in a direction intersecting with the axial direction.

The side surface 14B of the guiding rib 14A is a surface which intersects a direction parallel with the rotational axis L1 among the outer surfaces of the guiding rib 14A which has a rectangular cross section. The regulation part 15H is formed such that the regulation part 15H closes one side end of the roller portion 15C, and the roller shaft 15D is press-fitted in the regulation part 15H, thereby the stepped portion is formed and the regulating surface 15G is defined.

According to the embodiment, the regulating surface 15G is inclined, with respect to the central axis L1, such that a part thereof closer to the central axis L1 is further from the side surface 14B of the guiding rib 14A.

The driven roller 16 is arranged in parallel with the driving roller 15, and as shown in FIG. 1, a roller shaft 16A of the driven roller 16 is secured to the frames 17 such that the driven roller 16 is displaceable in a direction parallel with a direction in which tension is applied to bridging parts of the transfer belt 14. The bridging parts are planar parts of the transfer roller 14 bridged between the driving roller 15 and the driven roller 16, and indicated by reference numeral 14C.

The driven roller 16 is biased by a coil spring 19 in a direction in which a distance between the driving roller 15 and the driven roller 16 increases. Therefore, the driven roller 16 serves as a tension roller that applies a predetermined tension force to the bridging part 14C of the transfer belt.

The structure of the driven roller 16 is similar to that of the driving roller 15, and the driven roller 15 has a roller part (not shown) and a roller shaft 16A. A guiding rib 14 side axial end portion of the driven roller 16 is formed to have a stepped shape similar to the regulation portion 15H of the driving roller 15 so that the driven roller 16 does not interfere with the guiding rib 14A.

As shown in FIG. 2, the belt cleaner 21 is a unit for removing objects (e.g., developer) adhered on the transfer belt 14. The belt cleaner 21 includes a cleaning roller 21A and a backup roller 21B.

The cleaning roller 21A contacts the bridging part 14C which is further from the photoconductive drum 7A and removes the adhered objects therefrom. The backup roller 21B is arranged on an opposite side of the cleaning roller 21A with respect to the bridging part 14C, and biases the transfer belt 14 toward the cleaning roller 21A.

According to the embodiment, a predetermined voltage is applied between the cleaning roller 21A and the backup roller 21B. Further, the cleaning roller 21A, which contacts the transfer belt 14, rotates in a direction opposite to the moving direction of the transfer belt 14.

The objects adhered on the transfer belt 14 is frictionally exfoliated and electrostatically collected by the cleaning roller 21A. Then, the objects collected on the surface of the cleaning roller 21A is transported to a container 21D by a cleaning shaft 21C.

Incidentally, at a contact portion of the cleaning roller 21A and the transfer belt 14, an inhibitory force Fc that works to prevent the movement of the transfer belt 14 is applied. According to the embodiment, the cleaning roller 21A is configured such that the rotational shaft thereof extends in a direction which is inclined with respect to the moving direction of the transfer belt 14. Therefore, the inhibitory force Fc contains an axial-direction component, which will be referred to as an obliquely moving force.

According to the embodiment, the cleaning roller 21A is arranged to incline with respect to the moving direction of the transfer belt 14 so that the obliquely moving force to make the side end 14B of the guiding rib 14A contacts the regulation surface 15G of the driving roller 15.

Specifically, the cleaning roller 21A is inclined with respect to the moving direction of the transfer roller 14 so that the helical gear 15A side end portion of the cleaning roller 21A is located closer to the driving roller 15 side that the other side end portion in order to make the direction of the first thrust force coincide with the obliquely moving force.

According to the embodiment, when the helical gear 15A rotates and the driving gear 15 rotates, the first thrust force is applied to the helical gear 15A, the driving roller 15 is biased toward the opposite end side, the driving roller 15 is press-contacted to the thrust bearing 15B, thereby play of the driving roller 15 in the axial direction is reduced. Therefore, an oblique movement of the transfer belt 14 due to the axial displacement of the driving roller 15.

Therefore, when the transfer belt 14 moves obliquely in the direction which is the same as the direction in which the helical gear 15A causes the driving roller 15 to generate the first thrust force, and the regulating surface 15G contacts the side surface 14B of the guiding rib 14A, the side surface of the guiding rib 14A contacts the regulating surface 15G which is not displaced in the axial direction, thereby oblique movement of the transfer belt 14 is regulated.

According to the embodiment, the position of the driving roller 15 in the axial direction is determined as the first thrust force is received from the helical gear 15A, and the oblique movement force which causes the side surfaces 14B of the guiding ribs 14A to contact the regulation surface 15G. Therefore, it becomes possible to move the transfer belt with positioning the transfer belt 14 with respect to the driving roller 15 to which the regulation surface 15G is provided.

If the obliquely moving force for causing the side surfaces 14B of the guiding ribs 14A is not applied to the transfer belt 14, the transfer belt 14 may obliquely move such that the side surfaces 14B of the guiding ribs 14A move away from the regulating surface 15G.

According to the embodiment, however, the obliquely moving force for causing the side surfaces 14B of the guiding ribs 14A to contact the regulating surface 15G is applied to the transfer belt. Therefore, the side surfaces 14B of the guiding ribs 14A are prevented from moving away from the regulating surface 15G. Therefore, although the guiding ribs 14A and the regulating surface 15G are provided only one side in the axial direction, it is ensured that the oblique movement of the transfer belt 14 can be restricted.

Further, the inhibitory force Fc and the force Fd include a component in the same direction, even relationship between strengths of the forces Fc and Fd are changed, the axial components of the resultant force of the inhibitory force Fc and the force Fd always has the same direction. Therefore, it is possible to maintain the transfer belt 14 and the driving roller 15 in a stabled state. Accordingly, the oblique movement of the transfer belt 14 is stabilized.

According to the embodiment, the oblique movement force is applied to the transfer belt 14 by the belt cleaner 1 (i.e., the cleaning roller 21A) which is for removing the objects adhered on the transfer belt 14. Therefore, it is unnecessary to provide a mechanism for applying the oblique movement force to bias the side surfaces 14B of the guiding ribs 14A to the regulating surface 15G. Therefore, according to the embodiment, the oblique movement of the transfer belt 14 can be effectively regulated with suppressing increase of the number of members of the image formation device 1 (i.e., the belt unit 13).

Further, according to the embodiment, the distance between the regulating surface 15G and the side surface 14B of the guiding rib 14A is larger at a portion closer to the central axis L1. With this configuration, it is possible to suppress the transfer belt 14 from being lifted up so as to move away from the driving roller 15 and the like.

Figure 6A:
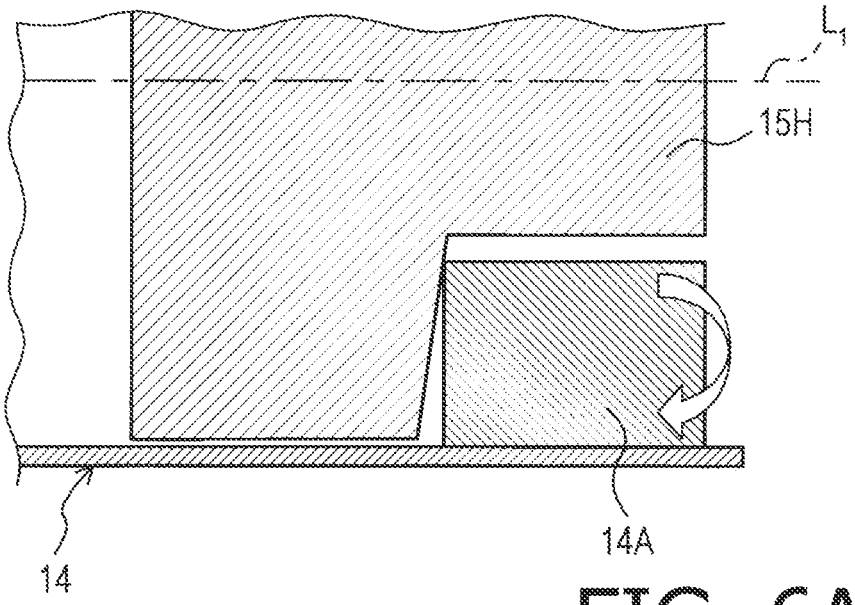
FIGS. 6A and 6B show comparative examples of the image formation device corresponding to that of the first embodiment.

If the distance between the regulating surface 15G and the side surface 14B of the guiding rib 14A is smaller at a portion closer to the central axis L1 as shown in FIG. 6A, the transfer belt 14 tends to deform such that the regulating surface 15G and the side surface 14B of the guiding rib 14A approaches due to the tension generated on the transfer belt 14. Therefore, the transfer belt 14 is lifted up to move away from the driving roller 15 and the like.

Figure 6B:
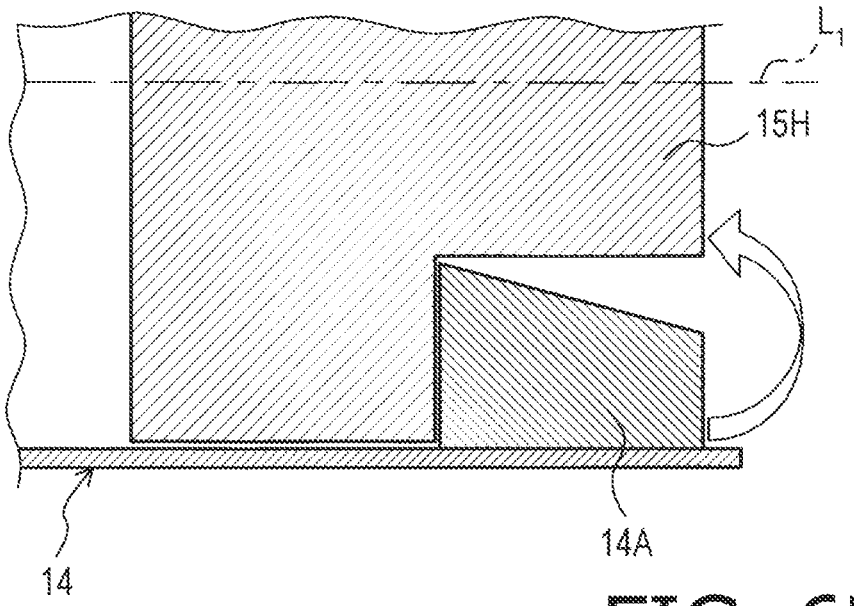

If the regulating surface 15G is arranged to be normal to the central axis L1 as shown in FIG. 6B, if the guiding ribs 14A are relatively new, the transfer belt 14 can be prevented from being lifted up from the driving roller 15 and the like. However, when the side surfaces 14B of the guiding ribs 14A are abraded, the side surfaces 14B will become substantially the same as those shown in FIG. 6A. Then, the transfer belt 14 may be lifted up from the driving roller 15 and the like, as described above.

Figure 5:
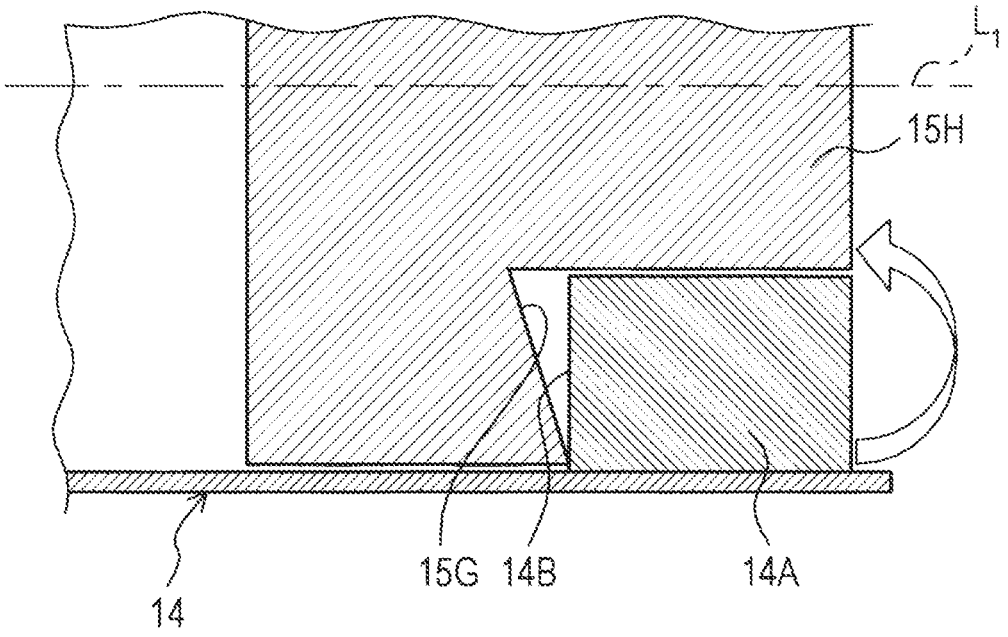
FIG. 5 is a partially enlarged view of a portion A indicated in FIG. 3B.

In contrast, according to the embodiment, since the distance between the regulating surface 15G and the side surface 14B of the guiding rib 14A is larger at a portion closer to the central axis L1, if the transfer belt deforms such that the regulating surface 15G and the side surface 14B of the guiding rib 14A approach each other as shown in FIG. 5. Therefore, it is possible to suppress the transfer belt 14 from being lifted up and separated from the driving roller 15 and the like.

Further, according to the embodiment, even if the side surfaces 14B of the guiding ribs 14A are abraded, the abrasion does not move to the extent that the distance between the side surface 14B of the guiding rib 14A and the regulating surface 15G is closer at a portion closer to the central axis L1. Therefore, according to the embodiment, it is possible to suppress the transfer belt 14 from being lifted up and separated from the driving roller 15 and the like.

Further, according to the embodiment, the driving roller 15 is provided with the thrust bearing 15B which receives the first thrust force applied by the helical gear 15A and regulate the axial position of the driving roller 15. With this configuration, it is ensured that the axial position of the driving roller 15 is regulated, and the oblique movement of the transfer belt is prevented.

Second Embodiment

Figure 7:
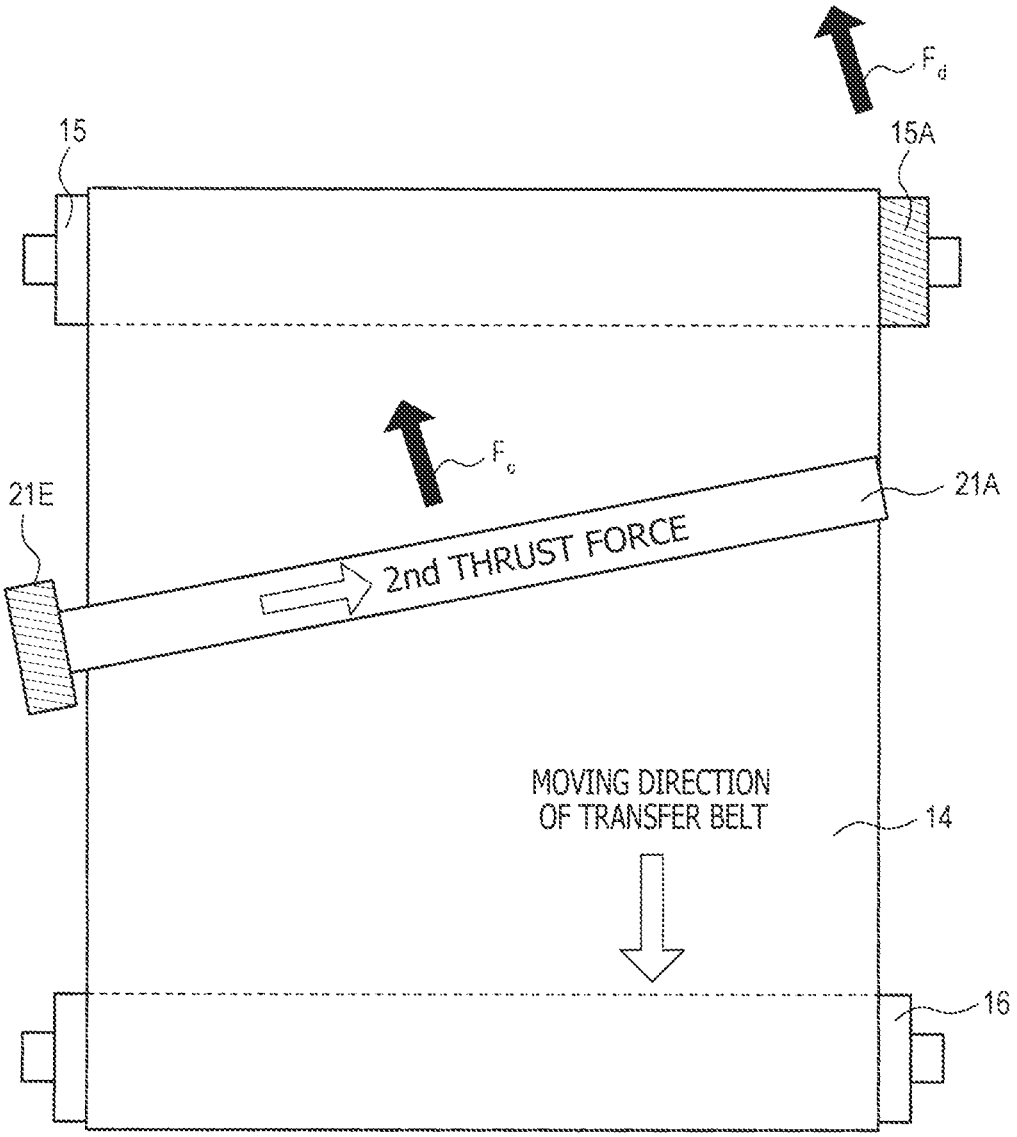
FIG. 7 shows a belt unit according to a second embodiment viewed from the belt cleaner side.

In the second embodiment, as shown in FIG. 7, a helical gear 21E for applying a rotational force to the cleaning roller 21A is provided at an axial end portion of the cleaning roller 21A. Further, the axial force the helical gear 21E applies to the cleaning roller 21A includes a component which is opposite to the first thrust the helical gear 15A applies to the driving roller 15. In the following description, the thrust force applied in the opposite direction will be referred to as a second thrust force.

In the second embodiment, the central axis of the helical gear 21E is inclined with respect to the central axis L1 of the driving roller 15. Therefore, a motor only for driving the belt cleaner 21 is provided. Further, the motor for the belt cleaner is arranged on the main body of the image formation device 1 such that the central axis of the motor for the belt cleaner 21 and the central axis of the helical gear 21E are parallel to each other.

The cleaning roller 21A applies a force to obliquely move the transfer belt 14 thereto. As a counteraction, the cleaning roller 21A receives a thrust force which has the same direction of the first thrust force the helical gear 15A applies to the driving roller 15.

However, according to the second embodiment, the second thrust force the helical gear 21E applies to the cleaning roller 21A includes a component working in the opposite direction of the first thrust force the helical gear 15E applies to the driving gear 15. Therefore, the counteraction (i.e., thrust force) the helical gear 21E applies to the cleaning roller 21 can be cancelled or weakened by the component of the second thrust force.

Therefore, according to the second embodiment, the cleaning roller 21A can be stably rotated, and the obliquely moving force can be stably applied to the transfer belt, and the oblique movement of the transfer can be regulated effectively.

Other Embodiments

According to the above embodiments, the regulating surface 15G (regulating portion 15H) is provided only to the driving roller 15. However, the invention needs not be limited to such a configuration, and the regulating surface may be provided to both the driving roller 15 and the driven roller 16, or only to the driven roller 16 instead of the driving roller 15.

Further, according to the above-described embodiments, the regulating surface 15G is provided on the same side of the helical gear 15A. The invention needs not be limited to such a configuration, and the regulating surface may be provided to a side opposite to the helical gear 15A.

In the above-described embodiments, the belt cleaner 21 (cleaning roller 21A) applies the oblique movement force to the transfer belt 14. The invention needs not be limited to such a configuration, and can be modified in different ways. For example, a blade-type cleaning device which does not rotate may be provided to contact the transfer belt 14 to serves as a device to apply the oblique movement force. For another example, the photoconductive drum 7A may be arranged to be inclined with respect to the moving direction of the transfer belt 14 to serve as the oblique movement force applying device.

According to the above embodiments, the oblique movement force is applied to the transfer belt 14 by arranging the cleaning roller 21A such that the axis of the cleaning roller 21A to be inclined with respect to the width direction. The invention needs not be limited to the above-described configuration, and can be modified in different ways. For example, by forming the cleaning roller 21A to have a cone-like tapered surface, it is possible to apply the oblique movement force to the transfer belt 14. For another example, by differentiating a contacting pressures at both ends of the cleaning roller 21A (or a blade-like cleaning unit), it is possible to apply the oblique movement tendency to the transfer belt 14.

Further, according to the above-described embodiments, the image formation device is a direct-type device in which the developer is directly transferred onto the sheet being fed by the transfer belt 14. The invention needs not to be limited to such a configuration, and can be applied to different types of image formation devices. For example, the image formation device may be an intermediate transfer type which is configured such that the developer is once transferred onto the transfer belt 14 and then transferred onto the sheet. For another example, the image formation device may be a inkjet type image formation device.

Further, the shape of the regulating surface 15 and/or the shape of the side surface 14B of the guiding rib 14A needs not be limited to that shown in FIG. 5, but can have the shape shown in FIG. 6A or 6B.

What is claimed is:

1. An image formation device configured to form an image on a sheet, comprising:

an image formation unit configured to form an image on a printing sheet; and a belt unit configured to convey the printing sheet to the image formation unit, the belt unit including:

a driving roller;

a driven roller;

an endless belt wound around the driving roller and the driven roller;

a driving helical gear integrally provided at an axial end of the driving roller, the driving helical gear rotating integrally with the driving roller, the driving helical gear applying a rotational force to the driving roller while applying an axial force to the driving roller;

a guiding rib provided to an inner surface of the endless belt, the guiding rib protruding inwardly and extending in a moving direction of the endless belt;

a regulating portion provided on at least one of the driving roller and the driven roller, the regulating portion having a regulation surface extending in a direction which intersects with an axial direction of the at least one of the driving roller and the driven roller; and an oblique force applying unit that applies an oblique movement force to the endless belt such that a side surface of the guiding rib forcibly contacts the regulating surface, wherein the oblique force applying unit is a component other than the drive roller or the driven roller, wherein the oblique force applying unit comprises a belt cleaner and a member;

wherein a contacting portion between the belt cleaner and the endless belt always extends in a direction inclined at an angle with respect to a direction perpendicular to the moving direction of the endless belt, wherein the member is arranged opposite the belt cleaner with respect to the endless belt and is configured to rotate and bias the endless belt toward the belt cleaner by forming a nip with the belt cleaner, wherein the member extends in the direction inclined at the angle with respect to the direction perpendicular to the moving direction of the endless belt, wherein the axial force and a component of the oblique movement force both act in a same direction, wherein the same direction is the axial direction, wherein the guiding rib and the regulating surface are provided only on an upstream side in the axial direction, with respect to the axial force and the oblique movement force, of the at least one of the driving roller and the driven roller, and wherein, when the endless belt moves in the axial direction, the side surface of the guiding rib contacts the regulating surface thereby preventing oblique movement of the endless belt.

2. The image formation device according to claim 1, wherein the belt cleaner is configured to remove objects adhered on the endless belt, and wherein the belt cleaner is driven to rotate in a direction such that the contacting portion moves in a direction opposite to the moving direction of the endless belt.

3. The image formation device according to claim 2, wherein the belt cleaner comprises:

a cleaning roller which contacts the endless belt while rotating; and a cleaning helical gear integrally provided at an axial end of the cleaning roller, the cleaning helical gear rotating integrally with the cleaning roller, the cleaning helical gear applying a rotational force to the cleaning roller while applying an axial force to the cleaning roller, wherein the axial force the cleaning helical gear applies to the cleaning roller includes a component in an opposite direction of the axial force the driving helical gear applies to the driving roller.

4. The image formation device according to claim 1, wherein a distance between the regulating surface and the side surface of the guiding rib is larger at a portion closer to a rotational axis of the at least one of the driving roller and the driven roller on which the regulating surface is provided.

5. The image formation device according to claim 4, wherein the regulating surface has an inclined surface which is configured such that a portion thereof closer to the rotational axis is further from the side surface of the guiding rib.

6. The image formation device according to claim 1, wherein the driving roller is provided with a force receiving portion configured to receive the rotational force and axial force from the driving helical gear.

7. The image formation device according to claim 1, wherein the regulating portion is provided at least to the driving roller, and wherein the guiding rib and the regulating surface are not provided on a downstream side in the axial direction.

8. The image formation device according to claim 1, wherein the driving roller is provided with a position regulating unit which receives the axial force applied by the driving helical gear to the driving roller and regulates an axial position of the driving roller.

9. A belt unit for an image formation device configured to form an image on a sheet, the belt unit comprising:

a driving roller;

a driven roller;

an endless belt wound around the driving roller and the driven roller;

a driving helical gear integrally provided at an axial end of the driving roller, the driving helical gear rotating integrally with the driving roller, the driving helical gear applying a rotational force to the driving roller while applying an axial force to the driving roller;

a guiding rib provided to an inner surface of the endless belt, the guiding rib protruding inwardly and extending in a moving direction of the endless belt;

a regulating portion provided on at least one of the driving roller and the driven roller, the regulating portion having a regulation surface extending in a direction which intersects with an axial direction of the at least one of the driving roller and the driven roller; and an oblique force applying unit that applies an oblique movement force to the endless belt such that a side surface of the guiding rib forcibly contacts the regulating surface, wherein the oblique force applying unit is a component other than the drive roller or the driven roller, wherein the oblique force applying unit comprises a belt cleaner and a member;

wherein a contacting portion between the belt cleaner and the endless belt always extends in a direction inclined at an angle with respect to a direction perpendicular to the moving direction of the endless belt, wherein the member is arranged opposite the belt cleaner with respect to the endless belt and is configured to rotate and bias the endless belt toward the belt cleaner by forming a nip with the belt cleaner, wherein the member extends in the direction inclined at the angle with respect to the direction perpendicular to the moving direction of the endless belt, wherein the axial force and a component of the oblique movement force both act in a same direction, wherein the same direction is the axial direction, wherein the guiding rib and the regulating surface are provided only on an upstream side in the axial direction, with respect to the axial force and the oblique movement force, of the at least one of the driving roller and the driven roller, and wherein, when the endless belt moves in the axial direction, the side surface of the guiding rib contacts the regulating surface thereby preventing oblique movement of the endless belt.

10. An image formation device configured to form an image on a sheet, comprising:

an image formation unit configured to form an image on a printing sheet; and a belt unit configured to convey the printing sheet to the image formation unit, the belt unit including:

a driving roller;

a driven roller;

an endless belt wound around the driving roller and the driven roller;

a driving helical gear integrally provided at an axial end of the driving roller, the driving helical gear rotating integrally with the driving roller, the driving helical gear applying a rotational force to the driving roller while applying an axial force to the driving roller;

a guiding rib provided to an inner surface of the endless belt, the guiding rib protruding inwardly and extending in a direction in which the endless belt moves; and a regulating portion provided on at least one of the driving roller and the driven roller, the regulating portion having a regulating surface extending in a direction which intersects with an axial direction of the at least one of the driving roller and the driven roller, wherein, when the endless belt moves in a direction in which the driving helical gear applies the axial force to the driving roller, a side surface of the guiding rib contacts the regulating surface thereby preventing oblique movement of the endless belt, wherein a distance between the regulating surface and the side surface of the guiding rib in the axial direction is largest at a portion closest to a rotational axis of the at least one of the driving roller and the driven roller on which the regulating surface is provided, and wherein the regulating surface has an inclined surface with respect to a direction perpendicular to the rotational axis which is configured such that a portion thereof closest to the rotational axis is farther from the side surface of the guiding rib in the axial direction than a portion thereof farthest from the rotational axis.

11. The image formation device according to claim 10, further comprising an oblique force applying unit that applies an oblique movement force to the endless belt such that the side surface of the guiding rib forcibly contacts the regulating surface, wherein the guiding rib and the regulating surface are provided on one side of the at least one of the driving roller and the driven roller in the axial direction.

12. The image formation device according to claim 11, further comprising a belt cleaner configured to remove objects adhered on the endless belt, wherein the belt cleaner serves as the oblique force applying unit.

13. The image formation device according to claim 12, wherein a contacting portion between the belt cleaner and the endless belt extends in a direction inclined with respect to a direction perpendicular to a moving direction of the endless belt.

14. The image formation device according to claim 12, wherein the belt cleaner comprises:

a cleaning roller which contacts the endless belt while rotating; and a cleaning helical gear integrally provided at an axial end of the cleaning roller, the cleaning helical gear rotating integrally with the cleaning roller, the cleaning helical gear applying a rotational force to the cleaning roller while applying an axial force to the cleaning roller, wherein the axial force the cleaning helical gear applies to the cleaning roller includes a component in an opposite direction of the axial force the driving helical gear applies to the driving roller.

15. The image formation device according to claim 10, wherein the driving roller is provided with a force receiving portion configured to receive the rotational force and axial force from the driving helical gear.

16. The image formation device according to claim 10, wherein the regulating portion is provided at least to the driving roller.

17. The image formation device according to claim 10, wherein the driving roller is provided with a position regulating unit which receives the axial force applied by the driving helical gear to the driving roller and regulates an axial position of the driving roller.

* * * * *